United States Patent [19]

Woodward

[11] 4,070,767

[45] Jan. 31, 1978

[54] APPARATUS AND METHOD FOR AERATING, VIBRATING AND ALIGNING SHEETS OF PAPER AND THE LIKE

[76] Inventor: Cyril H. T. Woodward, 160 Howard Ave., Rochelle Park, N.J. 07662

[21] Appl. No.: 700,840

[22] Filed: June 29, 1976

[51] Int. Cl.[2] ..... F26B 5/00

[52] U.S. Cl. ..... 34/33; 34/38; 34/163; 34/164

[58] Field of Search ..... 34/33, 38, 163, 164; 271/236

[56] References Cited

U.S. PATENT DOCUMENTS

| | | | |
|---|---|---|---|
| 2,724,089 | 4/1973 | Thompson et al. | 34/38 |
| 3,239,944 | 3/1966 | Gebert | 34/164 |
| 3,418,725 | 12/1968 | Ruud | 34/33 |
| 3,512,267 | 5/1970 | Eichholz et al. | 34/164 |
| 3,656,743 | 4/1972 | Ruud | 34/164 |
| 3,791,047 | 2/1974 | Atwood et al. | 34/38 |

*Primary Examiner*—John J. Camby
*Attorney, Agent, or Firm*—Ralph R. Roberts

[57] ABSTRACT

An apparatus and method for the stacking and restacking of printed paper, cardboard and the like are disclosed. Included in the apparatus is a turnover mechanism which receives stacks of sheets on a pallet or skid and, after clamping, turns this skid about ninety degrees so that the sheets are on edge and in a substantially vertical condition. There is provided a sheet edge support and in combination with this edge support are vibrating shoes which have air blast openings formed in their sheet engaging surfaces. These shoes are preferably flat and are vibrated so as to jog and move the sheets toward a stop which is preferably adjustable. The shoes may have an upwardly directed surface, if desired, and with this upward guidance the sheets are locally lifted when these vibrating shoes are moved underneath. The turnover mechanism has clamp means by which the stack is gripped and lifted. When the stack has turned about ninety degrees the turnover mechanism is stopped for the aligning operation. The shoes are carried by a side frame portion of the turnover mechanism. This side frame becomes the support and includes rib members between which the vibrating shoes are moved in a common plane. When the shoes are flat the upper shoe surface and the edge support for the sheets are in, and maintained in, a common plane. When the shoe surface is at least locally directed upwardly a small portion extends above the support plane to displace the sheets upwardly as the shoe passes underneath.

25 Claims, 18 Drawing Figures

APPARATUS AND METHOD FOR AERATING, VIBRATING AND ALIGNING SHEETS OF PAPER AND THE LIKE

BACKGROUND OF THE INVENTION

1. Field of the Invention

With reference to the classification of art as established in the United States Patent & Trademark Office the present invention is found in the general Class entitled, "Sheet Feeding or Delivering" (Class 271) and in the subclass therein entitled, "for front and side alignment of sheet" (subclass 236). Additionally note is made of the general Class entitled, "Drying and Gas or Vapor Contact with Solids" (Class 34) and the subclass therein entitled, "with treated material motion" (subclass 33).

2. Description of the Prior Art

The prior art has few patents directed to the stacking, restacking and aeration and vibration of stacks of printed sheets of paper, cardboard and the like. Among those known are the patents to RUUD as in U.S. Pat. Nos. 3,418,725 and 3,656,743. In these and other known apparatus for aligning the edges of stacked sheets it is believed to be new and novel to provide vibrating shoes which support the load and to direct a controlled blast of air through apertures in these shoes. This aeration has produced very satisfactory separation of sheets which are attracted to each other by only partially dried printing ink, static electricity or other naturally occurring conditions. Whether the shoes are flat or have an upward contour to simultaneously displace the edge arranged stack of material, the combination of vibration and blast of air at this vibration point provides a desired positive separation of the sheets in the stack.

Whereas the prior art devices, as shown in RUUD, employ air directed downwardly at the top of the sheets this seems to cause many of the sheets to cling together rather than separate as desired. In the preferred arrangement of the present invention there is provided automatic control means for directing an air blast to either the leading portion or trailing portion of the stack on the vibrating shoes. Whereas the RUUD vibrating device is by electromagnetic means it has been found advantageous to use a pneumatic vibrator so both the amplitude and frequency of the vibrations can be changed to suit the sheets being restacked.

In the present invention the air blast, as directed upwardly at and from the vibrating shoes, is of a larger volume and less velocity at the middle of the shoes than at the outer edges where a greater initial blast seems to be required to insure complete and positive separation of the sheets. An adjustable backstop is provided in the present apparatus so that the stack of paper, cardboard or the like is positioned in relation to the skid to restack the sheets in the desired position on the skid platform. Cutoff provision is provided on the air supply to the shoes so that where a shoe is not in contact with a stack of sheets the air to that shoe is cut off so as to maintain the desired air flow and pressure to the remaining shoes in vibrating engagement with the stack.

SUMMARY OF THE INVENTION

This invention utilizes a turnover mechanism in which a stack of sheets is placed on a skid or platform. Another skid or platform may be placed on top of the stack. Gripping platforms of the turnover mechanism are then moved toward one another to lift and grip the skid of material which is then turned so that the stack of sheets is more-or-less vertically positioned. These platforms are then loosened a small amount sufficient for the sheets to slide and be aligned. An adjustable stop is positioned at a determined relationship to the end of the stack and the skids so that when restacked the sheets are in the desired placement of the skid. A source of high volume, low pressure air of about twelve to fourteen inches pressure is now furnished to vibrating shoes which are passed successively under the sheets. At the same time, jet blasts of air are directed upwardly through the sheets and along the point of vibration. These blasts are at approximately the same velocity although the size of the outlet holes may vary. Where the length of the stack of sheets is less than the extent of shoes available, a shut off of pressurized air to the shoes not in engagement with the sheets is made so as to prevent loss of air pressure and volume to those shoes still cooperatively in vibrating engagement with the stack.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen specific embodiments of the vibration shoes and air cutoff means as adopted for use with a turnover mechanism and showing a preferred means for adjustably positioning the end of the stack of sheets. These specific embodiments have been chosen for the purpose of illustration and description as shown in the accompanying drawings wherein:

Figure 1:
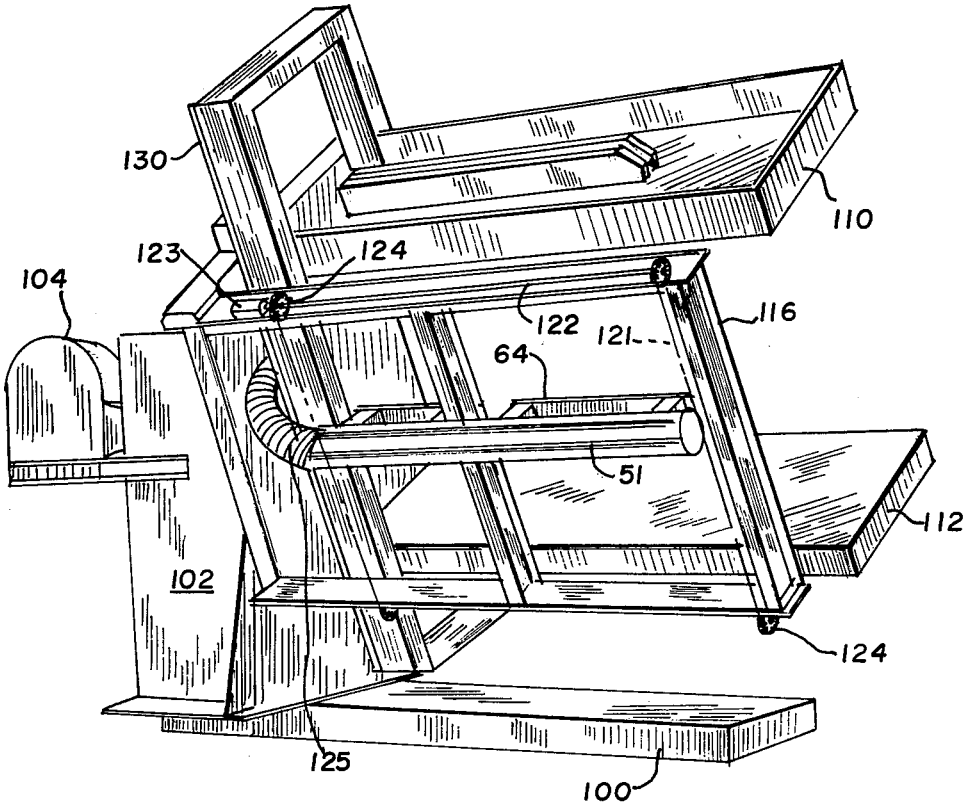
FIG. 1 represents a general isometric view of the turnover and jogging apparatus of this invention, this view partly diagrammatic and showing the general arrangement of the main components as they relate to this invention.

To the extent applicable the following application incorporates by reference U.S. Pat. No. 3,027,031, filed July 31, 1958 and issued on Mar. 27, 1962 and U.S. Pat. No. 3,464,317, filed July 28, 1967 and issued Sept. 2, 1969.

In the following description and in the claims various details are identified by specific names for convenience. These names, however, are intended to be generic in their application and corresponding reference characters refer to like members throughout the several figures of the drawings.

The drawings accompanying this specification disclose certain details of construction for the purpose of explanation but it should be understood that these structural details may be modified and that the invention may be incorporated in other structural forms than shown.

General Arrangement of Aerator Vibrator of FIG. 1

Referring now to FIG. 1, a vibrating and aerating apparatus includes a general frame 100 fixed in a pit or recess in the floor of the customer's plant. Carried by a front housing portion 102 is a turbine blower 104 supported thereon by means of brackets 106. Platforms 110 and 112 are carried by a turnover frame and are movable toward each other. Side frame 114 carries fixed members 116 and carries a vibrating conductor 51 which carries vibrating shoes 64. The conductor 51 is moved by means of roller chains 121. One of the two shafts 122 is rotated by motor 123. Sprockets 124 are carried on shafts 122 and are rotated to cycle vibrating shoes 64 which are more fully described hereinafter. These shoes receive pressurized air from blower 104 which feeds pressurized air to conductor 51 by means of flexible conduit 125. The operation of the individual components and sub-assemblies as shown in other Figs. will be discussed hereinafter.

Diagrammatic Showing of FIGS. 2, 3, 4 and 5

Figure 2:
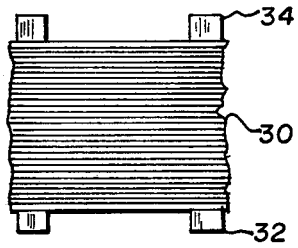
FIG. 2 represents a diagrammatic end view of a stack of sheets to be presented to the turnover and jogging apparatus of FIG. 1 and showing an additional skid or pallet placed on the stack of material if the material is to be turned 180°.
Figure 3:
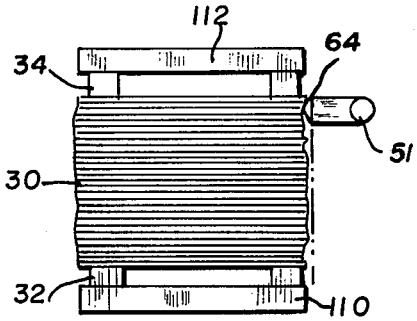
FIG. 3 represents the skid of FIG. 2 with the skid and pallets grasped by the platforms of the turnover mechanism preparatory to the turning for jogging and aerating.
Figure 4:
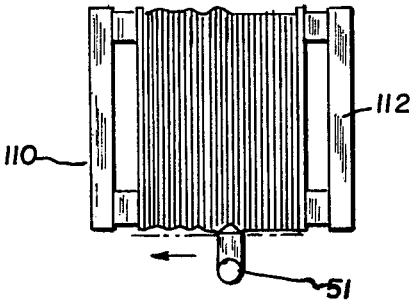
FIG. 4 represents an end view as in FIG. 3 but with the skid load now turned ninety degrees, the platforms loosened sufficiently to allow the jogging and aerating to be achieved.
Figure 5:
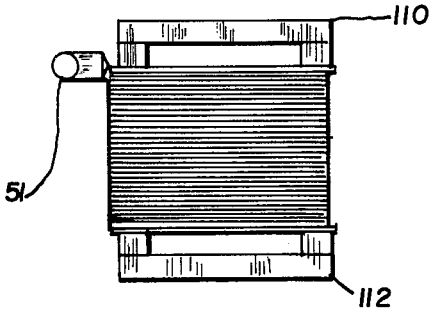
FIG. 5 represents the end view of FIG. 2 with the now aligned and aerated stack of sheets turned 180° and the stack now ready for transporting to processing of the other side of the sheets.

In FIGS. 2, 3, 4 and 5 is shown a diagrammatic representation of the actuation on the stack of sheet material which is brought to the aerating and vibrating apparatus. In FIG. 2, a typical skid of sheet material 30 is shown placed upon a lower skid 32. When and if the material is to be aerated and aligned and then turned 180°, an upper skid 34 which is similar to the skid 32 is placed on the top stack of sheets for convenience in transporting the skid after completion of the aerated alignment. In FIG. 3, the stack of sheets, seen in FIG. 2, is brought to the apparatus of FIG. 1 and, as seen in FIG. 3, is placed upon the lower platform 110. The platforms 110 and 112 are moved toward each other and the stack 30 is lifted to a turnover position. As seen in FIG. 4, the turnover mechanism has been turned approximately ninety degrees with the side frame and vibrator shoes 64 brought into a horizontal position above the floor at which time the platforms 110 and 112 are loosened sufficiently for aeration and vibration to occur and produce the desired results. The vibrator shoes 64 are cycled as to be hereinafter more fully described. The stock 30 is brought into aligned condition, as seen in FIG. 4. In FIG. 5, it is assumed that the stack of sheet material is to be printed on the opposite side whereupon a further ninety degree turn of the stack is achieved to bring the vibrator to the position seen in FIG. 5 with the platform 110 now being on top and the platform 112 being in the lower position and movable to a condition whereby it will be level with the floor. The stack may now be picked up and moved from the platform by an appropriate fork lift truck or the like.

Figure 6:
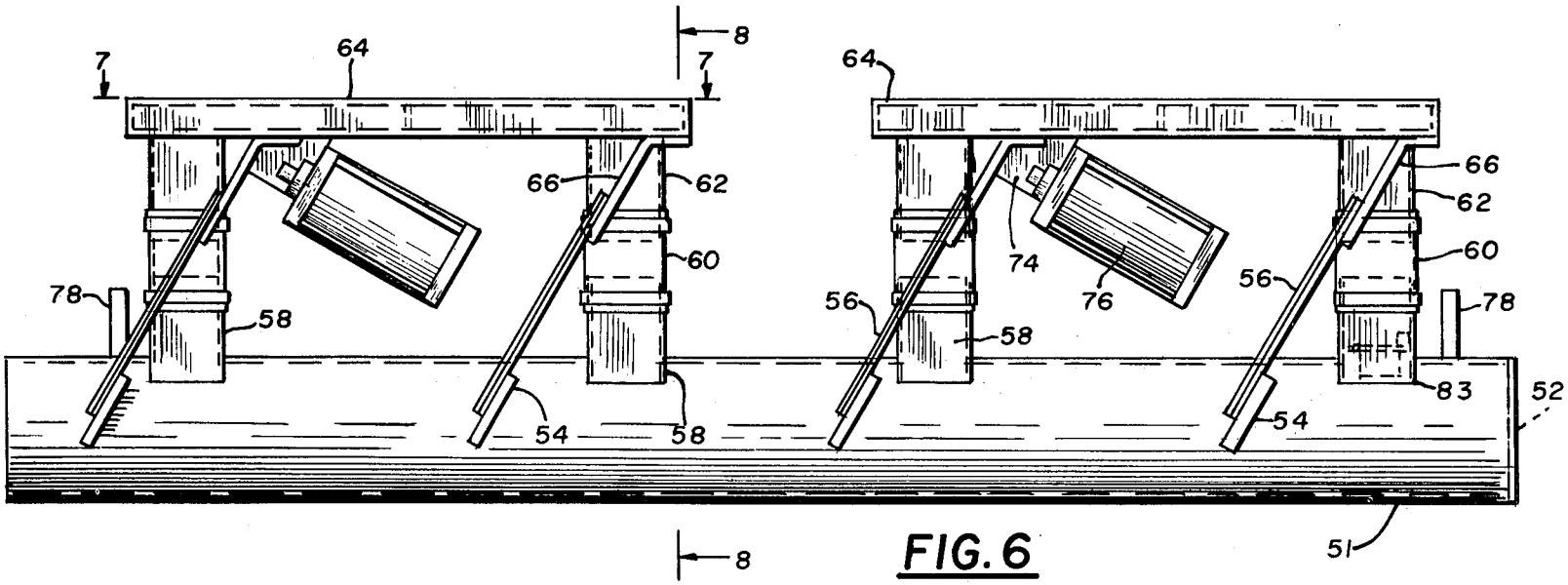
FIG. 6 represents a side view in an enlarged scale of a vibrator assembly including a pair of vibrated shoes, pneumatic vibrators and angled spring supports, a common air supply duct and a means for shutting off the air supply to one portion of a shoe.

Description of the Shoe Apparatus of FIG. 6

The diagrammatic side view of FIG. 6 depicts the vibrating shoe mechanism of this invention. As shown, a round tubular member, identified as conductor 51, and preferably a steel pipe, is closed at its right end by a closure member 52. On its left end the conductor 51 is open and connected to a source of high volume, low pressure air, to be herinafter more fully described. Conductor 51 is a steel tube which not only supplies a flow passageway for the high volume, low pressure air but also provides a support for the vibration apparatus and shoes. Attached to the sides of this conductor are spring support members 54. These support members 54 are welded in place at a determined angle and are disposed to carry on their lower ends spring members 56. These springs 56 are preferably leaf-type springs which are selected for their carrying strength and directional movement as well as for their vibrating capacity and ability to move in a fixed direction.

Attached and open to the tube 51 and open on the inside are air conductors 58. As depicted, there are four conductors which extend upwardly. The upper ends of these conductors are attached to flexible tubular boot members 60. These tubular boot members 60 are each attached to downwardly extending air conductors or connectors 62 which are attached at each end to the vibrating shoe members 64. As depicted, the air conductor located at the extreme right end of conductor 51 is the conductor closest to the entry between the forks and is shown as provided with a manual air shutoff means, as more fully described in FIGS. 10, 11 and 12.

Shoe members are retained in position by means of angle brackets 66 which are attached to the upper ends of springs 56 at one end and to the underside of the shoe member 64 at their other end. There are four of these brackets 66 on each shoe.

Shoe member 64 is depicted as a hollow member which is open on its underside to the connected air conductor 62 and is closed on its ends. Each of the shoes 64, as a hollow chamber, is connected to the high volume, low pressure air. Each top surface is formed with a plurality of outlets which, as shown, include in the present instance larger diameter openings 68 and smaller diameter openings 70. Jet openings 68 which are larger in size allow more air to flow from each opening than from the smaller jet openings 70. These smaller openings are used to initially provide a flow of highly concentrated air through the lossened stack as it is started to be vibrated. As depicted, there is a center divider 72 which apportions the air flowing into the shoes from each conductor 62. This air is discharged through only that half of the shoe connected to that associated conductor 62. A support bracket 74 is attached to the underside of vibrated shoe 64 and carries a vibrator 76 which in the present instance is contemplated to be an air actuated vibrator in which the speed and amplitude are varied to suit the requirements of the stack being aerated and aligned. Shown in FIG. 6 are the lugs 78 which are attached to roller chains by which this vibrating assembly of FIG. 6 is cycled back and forth.

Figure 8:
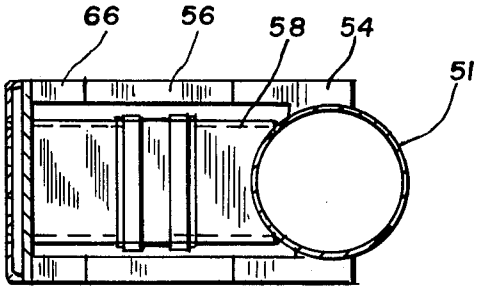
FIG. 8 represents a sectional view of the air delivery duct and shoe, this view taken on the line 8—8 of FIG. 6 and looking in the direction of the arrows.
Figure 7:
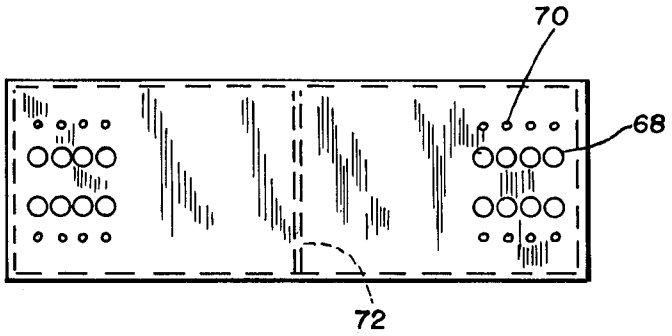
FIG. 7 represents a plan view of one of the shoes of FIG. 6, this view taken on the line 7—7 and looking in the direction of the arrows.

Use and Operation of the Vibrator Assembly of FIGS. 6, 7 and 8

As depicted and above-described, the air duct conductor 51 is made of steel tubing which not only provides a conduit for the high volume, low pressure air but also provides a support for the vibrating shoes 64. To the side walls of this tube are welded the spring supports 54 which are disposed at a determined angle, preferably between 30° and 45° to the plane of the stack supporting surface of the shoes. Apertures or openings are formed in the tubing 51 at which conductors 58 are attached and extend upwardly. Conductors 58 are connected by means of flexible boots 60 to conductors which are similarly attached to the underside of shoes 64. These shoes 64 are hollow and are disposed to distribute upwardly the air from the conductor 51. Air is only supplied to these shoes when a blower which supplies high volume, low pressure air is turned on, otherwise, no air is furnished to the vibrating shoes 64. The vibrators 76 are also controlled by the operator of the equipment and are turned on only at the time vibrating and/or aerating of the stack is to be accomplished. The holes 68 and 70 in the shoe top surface are shown with the larger holes 68 on the inside and the smaller holes 70 on the leading and trailing outer edges. Extensive experiments have shown that the above-described arrangement works more-or-less satisfactory with most stacks of material. It has also been found that placing the larger holes on the outside and the smaller holes on the inner row also produces satisfactory results in the case of certain printed cardboard. Whether there are two, three and more shoes is merely a matter of preference but in the present instance, and as reduced to practice, it has been found that two vibrating shoes have been very satisfactory.

Figure 9:
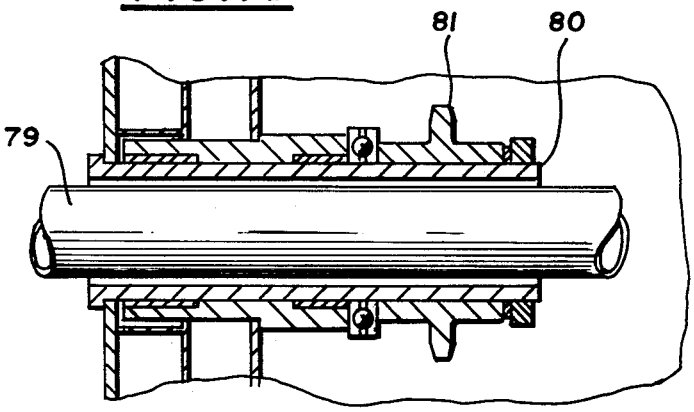
FIG. 9 represents a sectional view, partly diagrammatic and showing the pressurized air conduit as it is led through the hollow shaft portion carrying the turnover mechanism.

Center Conduit as Seen in FIG. 9

Shown in FIG. 9 is a center conduit 79 which leads from a high volume, low pressure air blower to the conduit 51 of FIG. 6. This conduit 79 passes through a hollow spindle 80 which is a member of the turnover apparatus. Instead of a separate conduit 79, the spindle 80 may provide the air conductor and this conductor also carries a sprocket 81 which is actuated by roller chain and hydraulic cylinders, to be hereinafter more fully described. The use of a hollow spindle in the turnover mechanism enables this turnover mechanism to be turned 180° at will and with no difficulty. The cycle of turn is always through the same half circle so there is no twisting of the conduit tube 79 beyond a small angular displacement.

Figure 10:
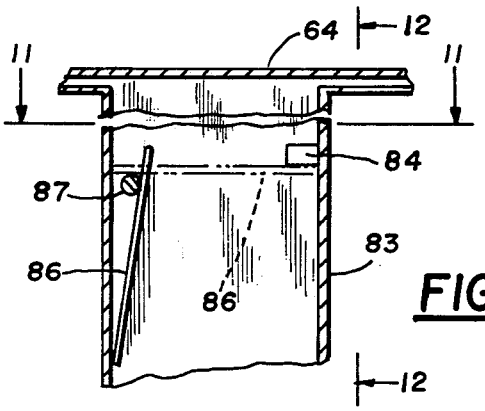
FIG. 10 represents a sectional side view, partly diagrammatic of a device by which the supply of pressurized air to a portion of the shoe is cut off, this shutoff device being automatically opened when the flow of pressurized air is stopped.
Figure 12:
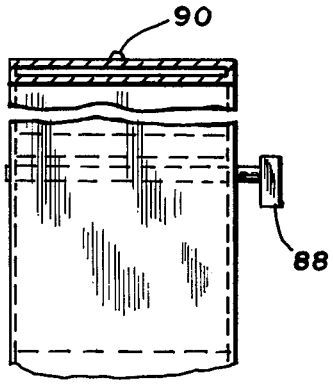
FIG. 12 represents an end view, partly diagrammatic, of the shutoff device of FIG. 10, this view taken on the line 12—12 thereof and looking in the direction of the arrows.
Figure 11:
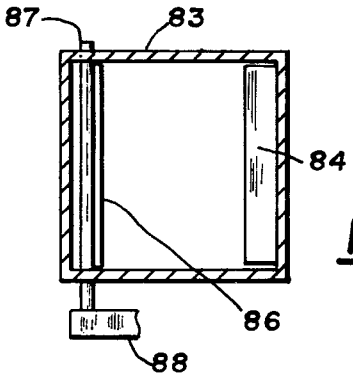
FIG. 11 represents an end view, partly diagrammatic, of the shutoff device of FIG. 10, this view taken on the line 11—11 thereof and looking in the direction of the arrows.

Air Flow Cutoff of FIGS. 10, 11 and 12

In FIGS. 10, 11 and 12 there is shown an automatic air cutoff which is manually manipulated into a closed condition and when the flow is terminated the cutoff member is automatically opened. As seen, the right end of air conduit 58 leading from the air supply conduit 51 is replaced or modified for the conduit 58, seen in FIG. 6. As modified, the right end is identified as conductor 83. The upper, inner end of this conductor is provided with a stop as shown in FIG. 10. The air conductor 83 has a stop member 84 formed or attached to the inner, side wall thereof. This stop member 84 may be a block attached to the inside of the conduit. Pivotally carried in this conductor 83 is a rectangular blade member 86 carried on and attached to the rod 87. This rod 87 is pivotally carried in the side walls of the conductor 83. Attached to one end of the rod 87 is a turn knob or lever 88 by which the rod and attached blade are manipulated to the horizontal condition of FIG. 10.

Use and Operation of the Cutoff Device of FIGS. 10, 11 and 12

The conductor 83 has a rectangular opening which is closed by the rectangular member 86 when said member is turned to a horizontal position and condition, as seen in FIG. 10. When the air flow in conductor 83 is turned off, the gravitational force on the member 86 causes the blade to swing downward to the condition seen in solid outline in FIG. 10. In this position an upward flow of air causes the blade closure member 86 to be urged into the position next to the side wall, as seen in solid outline in FIG. 10. To close the air flow to a selected portion of the upper part of the shoe 64 it is only necessary that after the air is flowing in the conductor 83 the lever 88 be turned to cause the member 86 to be swung to the horizontal position and against the stop member 84. The forward thrust or upward flow of air in the conductor 83 causes closure member 86 to remain in this position and shut off the flow of air to the right half of the right shoe 64. This cut off is desirable when a short stack of sheets is to be aerated and vibrated and the vibrating shoe surface is longer than the stack to be aerated. A loss or escape of air takes away from the effectiveness of the high volume, low pressure air supply flowing through the shoes. This cutoff, as seen in FIGS. 10, 11 and 12, is automatically opened after the pressurized air has been terminated and air no longer retains the member 86 in the horizontal position.

With the effect of the force of gravity it drops to the vertical condition, as seen in the solid outline in FIG. 10.

It is to be noted that depicted in FIG. 12 is a small half round member generally about one-half inch high and one inch wide which may be secured on the longitudinal length along the center, top portion of the shoe 64 to cause a short upward displacement of the sheets to occur as the vibrating shoes pass under the edges of the stack of sheets. This central member is identified as 90 and its use is a matter of choice.

Figure 13:
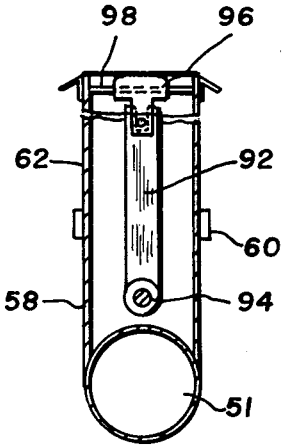
FIG. 13 represents a sectional view, partly diagrammatic, and showing a flow control apparatus which is cycled in response to the direction travel of the vibrating shoes and is disposed to direct the blast of air to exit from a selected portion of the shoe.

Automatic Cycling Apparatus as Seen in FIG. 13

Referring now to FIG. 13, there is shown an automatic cycling apparatus which selectively directs air to either the leading or trailing portions of the shoe 64. This is determined by the partial rotation of a rod control. As seen in FIG. 13, the conductor 51 has attached upward conductor assemblies of components 58, 60 and 62. Carried in these upward conductor assemblies is an upwardly extending arm 92 which is located and moved by a shaft 94 displaced longitudinally along and above the conductor 51. At the top end of this arm 92, and moved with its movement, is air shutoff block 96 which extends substantially the length of the shoe 64. This air shutoff block 96 is guided and slidably carried by and on rods 98 which are parallel to and contiguous to the top of the shoe 64. This block 96 is maintained in close proximity to the top of the shoe 64 so that when moved thereunder it effectively reduces or shuts off the flow of air issuing from the exposed or uncovered ducts which constitute about one-half of the air outlets in each shoe 64.

Operation of the Cycling Apparatus of FIG. 13

In operation the blocks 96 move from one side to the other side of the shoe 64. These blocks are carried on slide rods 98 and are moved in response to an oscillation of the arms 92 as carried on the shaft 94. This shaft 94 may be moved by a lever actuated by a cam, air cylinders or by a roller chain and sprocket. In operation, when it is determined that the leading portion of the shoe is to be supplied with air during the forward stroke, then as the shoe is moved leftwardly the block 96 is moved to the right side during the leftward travel and to the opposite side during the opposite travel. At the same time, the shoe is moved rightward and the block 96 is moved to the left side of the shoe. When the air jets to be opened are to be on the trailing edge of the shoe, the block 96 is moved to the left during the leftward movement of the shoe and to the right side of the shoe when the shoe is moved to the right. It is also contemplated that certain cycling procedures to be accommodated may have the block 96 moved to the middle of the shoe to cover or shut off the middle rows of jets so that only the small jets on the edge extremes of the shoe are open during certain cycling portions. The size of and movement provided by the block are selected to provide the blast and volume of air desired to be fed and delivered from the top of the shoe 64.

Figure 15:
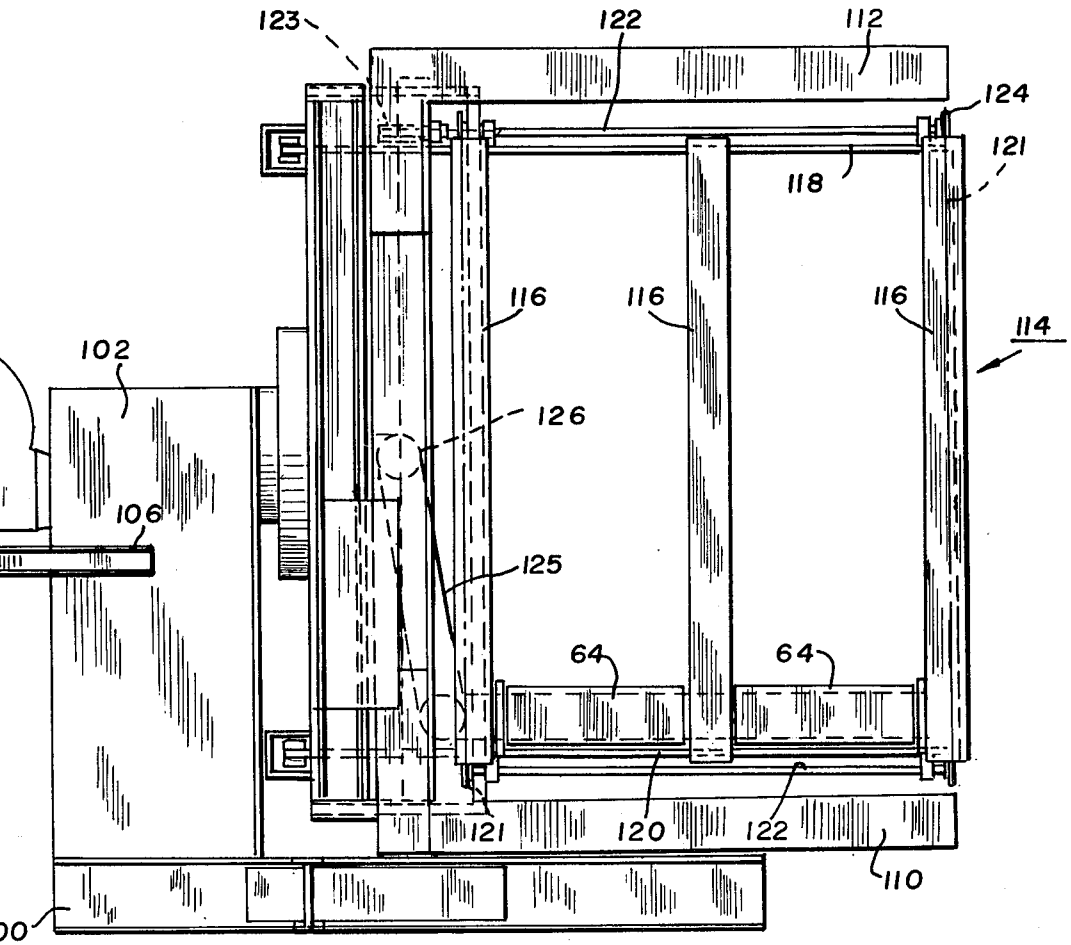
FIG. 15 represents a side view, partly diagrammatic and fragmentary and showing the vibration shoes and their relationship to the turnover mechanism of FIG. 14, the shoes and air conduit mechanism being shown in greater detail and in enlarged scale in FIG. 6.
Figure 14:
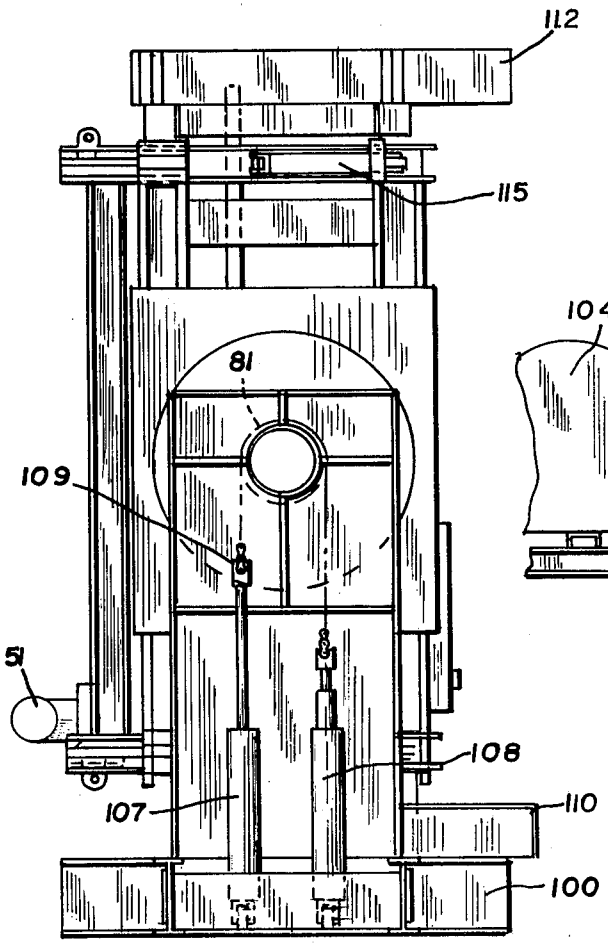
FIG. 14 represents an end view, partly diagrammatic and fragmentary and showing the turnover mechanism portion of the apparatus of this invention.

Platform Life Apparatus of FIGS. 14 and 15

Referring next to FIGS. 14 and 15, there is shown a general arrangement of the platform lift apparatus of this invention. As depicted, frame 100 is contemplated to be fixed in a portion of a floor so as to be in a stationary position. The top of this frame is positioned so that the top surface of a platform member is more-or-less in coincidence with the floor so that pallets carried by power equipment, fork lift trucks and the like may be placed on the lower of the platform members of the turnover, vibrating and aerating equipment. Associated with this frame 100 is a mechanism housing 102 in which are housed hydraulic, electric motors and various other equipment which provide the actuation of this apparatus. On the outer portion of this housing 102 is carried a rotary air compressor 104 which produces the supply of high volume, low pressure air providing the blast of air desired in the shoes 64, above-described. This turbine, blower-type air supply is carried on rail supports 106 fastened to the frame 102.

In FIG. 14 is shown a like pair of hydraulic cylinders 107 and 108 which are connected to and move a roller chain 109 which drives sprocket 81 by which the turnover mechanism of this apparatus is rotated. The turnover mechanism, when rotated by two cylinders 107 and 108, is turned around the fixed center axis of rotation and is not lifted from its initial position. In my U.S. Pat. No. 3,027,031 which issued on Mar. 27, 1962 there is shown a movable platform and a turnover mechanism in which the platforms are carried by the axis of the turnover mechanism which is lifted by a cylinder. The platforms of the apparatus shown in the Patent are moved to and from each other by a single hydraulic cylinder. This has been changed in the present embodiment. The turnover mechanism and platform lifting mechanism follow the teaching of the hydraulic circuit shown in my U.S. Pat. No. 3,464,317 which issued on Sept. 2, 1969.

In the present embodiment lift platforms 110 and 112 are wider than the stack of sheet material and, in the present instance, the lower lift platform 110 receives the pallet upon which the stack of material is placed. Between these two lift platforms 110 and 112 is the side frame 114 which normally is at its maximum open condition until automatically moved after the lift platforms 110 and 112 have been moved toward clamping position. This side frame generally indicated as 114 is moved inwardly by means of cylinders 115. Three rib members 116 extend between the header members 118 and 120. These rib members provide the fixed support for the stack of paper or material which is aerated and vibrated by the shoes 64.

The tube 51 and the vibrating shoe apparatus carried thereon is moved back and forth by means of a roller chain 121 which is moved by sprockets 124 mounted on shaft 122. One of the shafts 122 is rotated by hydraulic motor 123 supplied by a hydraulic system carried within a housing 102. A flexible conduit 125 extends from an outlet 126 on the inner end of spindle 80 (FIG. 9) and provides a conduit for the high volume, low pressure air furnished by blower 104 to the vibrating shoes 64.

Use and Operation of the Apparatus of FIGS. 14 and 15

In operation the stack of sheet material 30 is transported by means such as a fork lift truck and is placed upon the lower lift platform 110. The operator then removes the fork lift truck leaving the stack of sheet material between the platforms 110 and 112. The operator of the aeration and vibration apparatus by means of appropriate push button starts the hydraulic and blower motors. The platforms 110 and 112 are brought into clamp position on the stack of material. The side frame 114 is automatically brought or moved from its outer position to its inner position into engagement with the side of the stack as soon as the platforms 110 and 112 have moved from their extreme open position. The side frame 114 as it moves into a fixed, inner position aligns the pallet and the material thereagainst with side frame members 116. This turned frame 114 provides a fixed support for the material after the platforms have been brought into the clamped condition and the turnover frame is rotated approximately 90° to bring the material into the condition as seen in FIG. 3.

At this condition the platforms 110 and 112 are loosened to the extent desired so that the stack is loosely held between the platforms. The stack of sheets is then vibrated amd aerated. With the blower 104 turned on, the cycling is begun. The vibrating shoes 64 are moved back and forth underneath the stack of material with the vibrations and the aeration of the stack of material locally occurring. After one back and forth cycle is completed, the stack is usually sufficiently aerated and aligned. This vibration and aeration is terminated when the stack has been satisfactorily aerated and aligned. The platforms 110 and 112 are then brought together and a turning of the aligned stack is made. Depending upon the ultimate process to be performed on the stack of sheets, the stack is either returned to its original position or is turned one hundred and eighty degrees from its original condition. This turning of the stack one hundred and eighty degrees is desirable if the material is to be printed on two sides and the aeration and alignment of the stack are needed for bringing the material into an aligned condition for the grippers of the printing mechanism.

Figure 17:
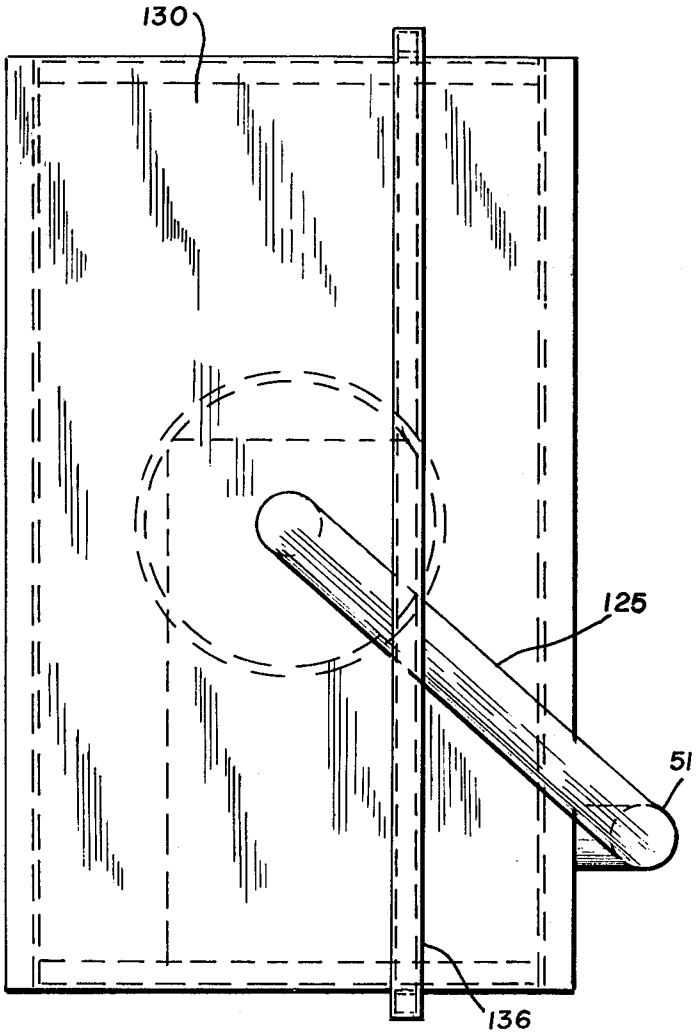
FIG. 17 represents an end view, partly fragmentary and diagrammatic of the turnover frame and the adjustable stop as mounted thereon and as shown in FIG. 16.
Figure 16:
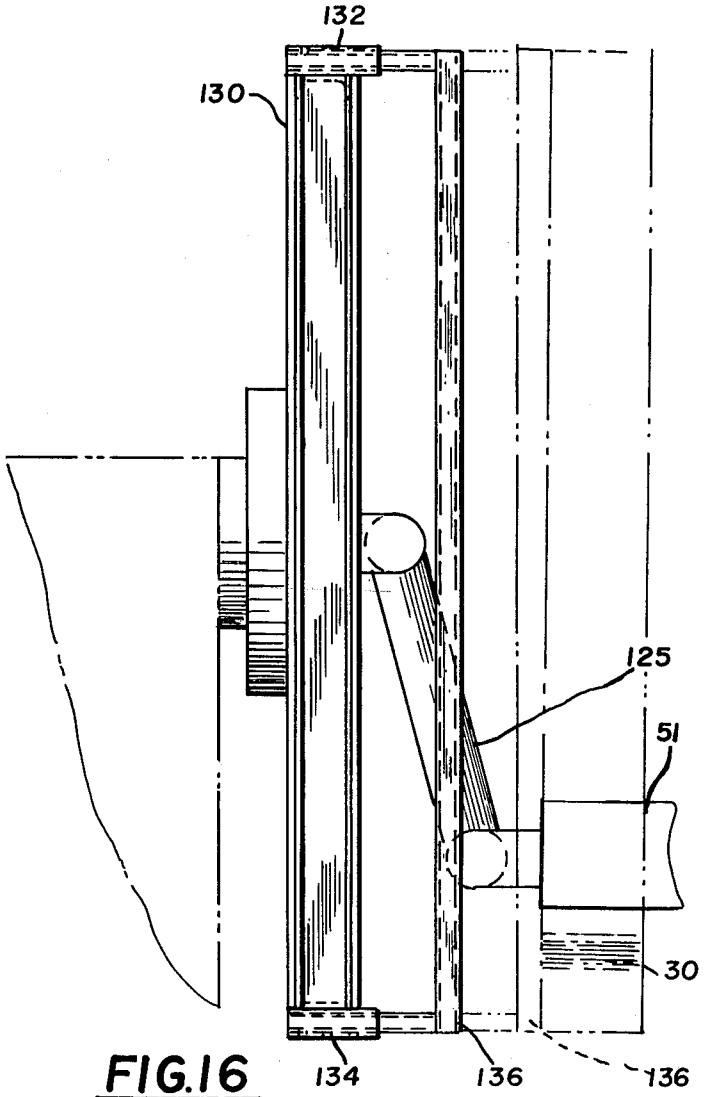
FIG. 16 represents a side view, partly diagrammatic and fragmentary of an adjustable stop for positioning the aerated and aligned stack of sheet material.

Back Stop Apparatus of FIGS. 16 and 17

As seen in FIGS. 16 and 17, there is provided an adjustable stop whereby a stack of sheets 30 may be brought to a determined position in relation to a desired position on the pallet. As depicted, a header frame 130 has upper and lower guides 132 and 134 attached at the ends thereof. Movable in these guides and locked in the selected position by manual or automatic means is an end stop member 136. This end stop member is movable to a forward position such as is shown in phantom outline in FIG. 16. In the selected position the stack of sheets 30 as vibrated and aerated is moved to a fixed forward position. This fixed adjustable end stop 136 preferably has an adjustable range of about 6 to 8 inches which allows the stack of sheets to be brought to a desired position in relation to the pallet. It is to be noted that the end stop member 136 is approximately 12 inches or more above the vibrating shoes carried by the conduit 51. As positioned, stop 136 allows the stack of sheet material to be positioned in relationship to the skid at any selected position.

Figure 18:
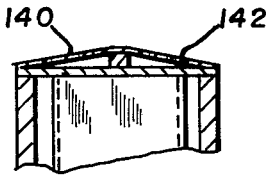
FIG. 18 represents a side view, partly fragmentary and showing an alternate shoe construction in which the material engaging surface of the shoe has a sloped top which peaks at a point above the normal rest line of the stack of material.

Alternate Shoe Construction as Seen in FIG. 18

Referring next and finally to FIG. 18, it is to be noted that the shoe instead of being flat, as shown in FIG. 8, may have a sloped contour as seen in FIG. 18. As shown in this configuration aeration to and through these sloped surfaces of the top of the shoes is provided in the same manner as in the flat shoes, above described in FIG. 8. Instead of the flat upper surface of the shoe 64, seen in FIG. 8, sloped surfaces 140 and 142 are shown in FIG. 18. These upward sloped surfaces 140 and 142, as the vibrated shoes are passed underneath the stack, cause an upward displacement of the sheets and at the same time the aeration is initiated. Although this sloped shoe works more-or-less satisfactorily, it has been found that a sloped shoe is not necessary in most stacks of material where a satisfactory vibration and aeration occurs. Flat shoes do not require or cause any lifting and displacement of the stack of sheet material.

It has been found that a spraying of the sheet engaging surfaces of the flat shoes 64 with an application of tungsten plasma provides a roughened surface. This increases the coefficient of friction of the sheet material in contact with the support surfaces of the shoes 64 of the vibrating and aerating mechanism. The increase in the coefficient of friction has proved to be a very satisfactory assist to the vibration apparatus and at the same time prevents the top surfaces of the shoes from becoming polished and also prevents a ready sliding of the shoes underneath the sheets when and as the vibration and aeration occurs.

As a method the above apparatus provides aerating and vibrating of a stack of sheet material such as cardboard, paper and the like in which the stack is transportable on a skid to said apparatus, said method steps including: providing a lift frame including a pair of platform members and moving these platform members toward one another so as to engage a stack of sheets on its flat top and bottom surfaces and grasping said stack and when so grasped lifting the stack sufficiently so as to be turned to bring the stack to a vertically edgewise condition and after turning, moving the platforms apart sufficiently to permit aerating and vibrating of the loosened stack of sheets; providing a side support frame carried by the lift frame and moving the frame to a position whereat one edge of the stack is supported and is aligned; providing and cycling a vibrator support frame and carrying this support frame on the side frame and moving the vibrator frame back and forth at a selected and determined speed; positioning a vibrated shoe carried on a support structure and moving this shoe and structure in a common plane and line which is substantially coincident with a plane normal to the bottom supported edge of the sheet; mounting a spring at such an angle that these springs are disposed to carry the shoe during the vibrating of this shoe and during vibration to carry and move locally the sheets in association with the shoe to a stop surface provided on the side frame; mounting on the shoe a vibrator having a cycle and amplitude adjusting means and carrying said vibrator on said shoe so that the imposed vibrations are in a plane substantially parallel to the plane of the sheets in the stack; providing and carrying an air conduit so as to be movable with the vibrator frame, this air conduit supplied with a large volume of low pressure air and disposed to feed this air to the vibrated shoe; forming air passageways at and in the carrying surface of the shoe and connecting these air passageways to the conduit so that a large volume of low pressure air from the conduit is supplied to these passageways, and forming a plurality of air outlets in the carrying surfaces of each shoe, each of the outlets so formed and positioned as to direct a stream of pressurized air upwardly and locally to and through the stack of sheet material as and after the platform members holding this material are loosened to allow vibration and aerating of the stack of sheets.

It is to be noted that springs 56, shown as leaf springs, may also be rubber isomodes or similar resilient means. Leaf springs in use tests have proved to be superior to provide the movement of the sheets in the stack most desired. It is necessary that this spring member while permitting vibrations to occur within determined limits also at the same time provide a support so that the shoes may be maintained at a constant supportive level while vibrating. The vibration member 76 although preferably of a pneumatic or hydraulic actuation can also be an electric or mechanically developed actuation.

The outlet holes 68 and 70, although shown as dissimilar in size and in rows, may be arranged in a random pattern and the size and frequency of holes is dependent on the material to be aerated and the capacity of the blower. Very narrow slots can be used instead of holes but this has proved wasteful of pressurized air and the extra capacity needed in the blower to provide the penetrating blast needed for successful aerating has not proved to be beneficial.

The shoe member 64 may be a flat plate instead of the hollow form shown. As a flat plate the connectors 62 are attached directly to the underside of the plate and holes 68 and 70 are formed only in that portion of the plate above connectors 62. In the use of a plate, divider 72 is not required or provided.

Whether the selective cutoff or movable member, seen in FIGS. 10 thru 13 is provided or used is merely a matter of selection and/or the material and size of the sheet stack to be aerated and vibrated. One long shoe or many short shoes may be used but it is to be noted that the vibration efficiency is to be maintained and the size and spring support of the shoe is proportional to the length of the shoe.

Terms such as "left", "right", "up", "down", "bottom", "top", "front", "back", "in", "out", "clockwise", "counterclockwise" and the like are applicable to the embodiments shown and described in conjunction with the drawings. These terms are merely for the purpose of description and do not necessarily apply to the position in which the aerating and vibrating apparatus may be constructed or used.

While a particular embodiment of the aerating and vibrating apparatus and modifications has been shown and described it is to be understood the invention is not limited thereto and protection is sought to the broadest extent the prior art allows.

What is claimed is:

1. An aerating and vibrating apparatus for a stack of sheet material such as cardboard, paper and the like, which stack is transportable on a skid to said apparatus, said apparatus including: (a) a lift frame including a pair of platform members and means for moving these platform members toward one another so as to engage a stack of sheets on its flat top and bottom surfaces and grasp said stack and when so grasped the stack is lifted and then is turned sufficiently to bring the stack to a substantially vertical edgewise condition and after turning to move the platforms apart sufficiently to permit aerating and vibrating of the loosened stack of sheets; (b) a side support frame carried by the lift frame and movable to a position whereat one edge of the stack is supported and is aligned thereby; (c) a vibrator support frame carried by the side frame and cycled by control means so as to move from one side of the support frame and back at a selected and determined speed; (d) at least one movable shoe carried by a support structure, both the shoe and structure movable in a common plane and line which is substantially coincident with a plane normal to the bottom supported edge of the sheet as provided by the side support frame; (e) means for vibrating the movable shoe in a controlled direction and amplitude and toward and away from the side frame, the vibrated shoe having a flat support surface at that portion which is brought into engagement with the supported edges of the stack of sheets when the stack is lifted and turned, the vibrated shoe agitating the sheets as the air is blown therebetween without a lifting of the sheets by the vibrated shoe above the support surface provided by the side support frame; (f) a spring means disposed to carry the shoe during the vibrating of the shoe and during vibration to carry and move locally the sheets in association with the shoe to a stop surface provided on the side frame; (g) a vibrator having a cycle and amplitude adjusting means, said vibrator carried by and on said shoe and the support structure so that the imposed vibrations are in a plane substantially parallel to the plane of the sheets in the stack; (h) an air conduit carried by and movable with the vibrator frame, this air conduit supplied with a large volume of low pressure air and disposed to feed this air to the vibrated shoe; (i) air passageways provided at the carrying surface of the shoe, these air passageways connected to the conduit so that a large volume of low pressure air from the conduit is supplied to these passageways, and (j) a plurality of air jet outlets formed in the carrying surfaces of the shoe, each of the outlets so formed and positioned as to direct a stream of pressurized air upwardly and locally to and through the stack of sheet material as and after the platform members holding this material are loosened to allow vibrating and aerating of the stack of sheets.

2. An aerating and vibrating apparatus as in claim 1 in which the side support frame is automatically moved to its inner stop limit by and with the moving of the platform members toward each other.

3. An aerating and vibrating apparatus as in claim 1 in which the platform members are carried by a turnover mechanism which includes the lift frame, the mechanism and frame having a fixed axis around which they are rotatable to carry the frame and platform members through one-hundred eighty degrees of rotation.

4. An aerating and vibrating apparatus as in claim 3 in which the platform members, the turnover mechanism and a hydraulic motor by which the vibrator mechanism is cycled are powered by a high pressure oil hydraulic system.

5. An aerating and vibrating apparatus as in claim 1 in which the source of high volume, low pressure air is supplied by a centrifugal blower.

6. An aerating and vibrating apparatus as in claim 5 in which the air supplied to the vibrating shoes is carried to and through a hollow spindle which carries the lift frame and which is axially turned to provide the desired rotation of this lift frame.

7. An aerating and vibrating apparatus as in claim 1 in which the vibrators are pneumatic and are adjustable as to speed and amplitude.

8. An aerating and vibrating apparatus as in claim 1 in which the lifting surface of that platform in the lower and vertical open condition is substantially coincident with the floor of the plant in which the apparatus is installed.

9. An aerating and vibrating apparatus as in claim 1 in which there is provided an adjustable forward stop carried by the lift frame and selectively movable to a position above a skid on which the stack of sheets is carried, this stop being moved and locked in position to establish a stop edge on the stack of sheets on the skid.

10. An aerating and vibrating apparatus as in claim 1 in which the surface of the shoe in sliding contact with the stack of sheets is coated with material to increase the coefficient of friction with the edges of the material and the shoe carrying surface.

11. An aerating and vibrating apparatus as in claim 1 in which there are two vibrating shoes.

12. An aerating and vibrating apparatus as in claim 1 in which the shoe is a hollow chamber member with a divider in the hollow chamber for the air flow.

13. An aerating and vibrating apparatus as in claim 1 in which the shoe is a flat plate and the air passageways are directly attached to the underside of said plate.

14. An aerating and vibrating apparatus as in claim 1 in which each spring means is a leaf spring assembly.

15. An aerating and vibrating apparatus as in claim 14 in which the leaf springs are disposed at an angle between one and sixty degrees to the carrying surface of the shoe.

16. An aerating and vibrating apparatus for a stack of sheet material such as cardboard, paper and the like, which stack is transportable on a skid to said apparatus, said apparatus including: (a) a lift frame including a pair of platform members and means for moving these platform members toward one another so as to engage a stack of sheets on its flat top and bottom surfaces and grasp said stack and when so grasped the stack is lifted and then is turned sufficiently to bring the stack to a substantially vertical edgewise condition and after turning to move the platforms apart sufficiently to permit aerating and vibrating of the loosened stack of sheets; (b) a side support frame carried by the lift frame and movable to a position whereat one edge of the stack is supported and is aligned thereby; (c) a vibrator support frame carried by the side frame and cycled by control means so as to move from one side of the support frame and back at a selected and determined speed; (d) at least one movable shoe carried by a support structure, both the shoe and structure movable in a common plane and line which is substantially coincident with a plane normal to the bottom supported edge of the sheet as provided by the side support frame; (e) means for vibrating the movable shoe in a controlled direction and amplitude and toward and away from the side frame, the vibrated shoe agitating the sheets as the air is blown therebetween; (f) a spring means disposed to carry the shoe during the vibrating of the shoe and during vibration to carry and move locally the sheets in association with the shoe to a stop surface provided on the side frame; (g) a vibrator having a cycle and amplitude adjusting means, said vibrator carried by and on said shoe and the support structure so that the imposed vibrations are in a plane substantially parallel to the plane of the sheets in the stack; (h) an air conduit carried by and movable with the vibrator frame, this air conduit supplied with a large volume of low pressure air and disposed to feed this air to the vibrated shoe; (i) air passageways provided at the carrying surface of the shoe, these air passageways connected to the conduit so that a large volume of low pressure air from the conduit is supplied to these passageways, and (j) a plurality of air jet outlets formed in the carrying surfaces of the shoe, each of the outlets so formed and positioned as to direct a stream of pressurized air upwardly and locally to and through the stack of sheet material as and after the platform members holding this material are loosened to allow vibrating and aerating of the stack of sheets, the pressurized air which is fed to a shoe is divided and the flow to said shoe is supplied through plural conductors with one of these conductors selectively closed by a blade member which is turned from its at rest position to substantially block the flow of air through that conductor to the vibrating shoe, said blade member being pivotally attached at one end to a rod and when the blade is moved at least partially transverse to the conductor in which it is mounted it closes the conductor to the flow of pressurized air.

17. An aerating and vibrating apparatus as in claim 16 in which the blade is limited in its swing to a cutoff condition by a stop means provided in the conductor, and this blade member is maintained in this cutoff condition by the force of the pressurized air and when the flow of air is terminated the blade member swings to an open condition by the gravitational force thereon and remains in this open condition during subsequent air flow through the conductor until the blade is again deliberately turned to a cutoff condition.

18. An aerating and vibrating apparatus as in claim 16 in which the vibrating shoe has a tented support surface at that portion which is brought into engagement with the supported edges of the stack of sheets, the vibrated shoe agitating the sheets as the air is blown therebetween and the tented surface providing an upward and downward slope to displace the sheets upwardly as the shoe is moved underneath.

19. An aerating and vibrating apparatus as in claim 16 in which the vibrating shoe has a generally flat surface and substantially midwidth thereof there is a small tented member which engages the sheets when brought into engagement therewith so that a small upward an downward movement is caused on the sheets as they are vibrated and the air is blown therebetween.

20. An aerating and vibrating apparatus for a stack of sheet material such as cardboard, paper and the like, which stack is transportable on a skid to said apparatus, said apparatus including: (a) a lift frame including a pair of platform members and means for moving these platform members toward one another so as to engage a stack of sheets on its flat top and bottom surfaces and grasp said stack and when so grasped the stack is lifted and then is turned sufficiently to bring the stack to a substantially vertical edgewise condition and after turning to move the platforms apart sufficiently to permit aerating and vibrating of the loosened stack of sheets; (b) a side support frame carried by the lift frame and movable to a position whereat one edge of the stack is supported and is aligned thereby; (c) a vibrator support frame carried by the side frame and cycled by control means so as to move from one side of the support frame and back at a selected and determined speed; (d) at least one movable shoe carried by a support structure, both the shoe and structure movable in a common plane to the bottom supported edge of the sheet as provided by the side support frame; (e) means for vibrating the movable shoe in a controlled direction and amplitude and toward and away from the side frame, the vibrated shoe agitating the sheets as the air is blown therebetween; (f) a spring means disposed to carry the shoe during the vibrating of the shoe and during vibration to carry and move locally the sheets in association with the shoe to a stop surface provided on the side frame; (g) a vibrator having a cycle and amplitude adjusting means, said vibrator carried by and on said shoe and the support structure so that the imposed vibrations are in a plane substantially parallel to the plane of the sheets in the stack; (h) an air conduit carried by and movable with the vibrator frame, this air conduit supplied with a large volume of low pressure air and disposed to feed this air to the vibrated shoe; (i) air passageways provided at the carrying surface of the shoe, these air passageways connected to the conduit so that a large volume of low pressure air from the conduit is supplied to these passageways, and (j) a plurality of air jet outlets formed in the carrying surfaces of the shoe, each of the outlets so formed and positioned as to direct a stream of pressurized air upwardly and locally to and through the stack of sheet material as and after the platform members holding this material are loosened to allow vibrating and aerating of the stack of sheets, the air to the shoe flowing into a substantially closed chamber positioned immediately below the carrying surface of the shoe and forming a portion of the shoe and air from that chamber discharged from the plurality of jet outlets in the shoe, the outlets arranged in rows which are substantially parallel to the longitudinal edges of the shoe and a sliding block carried in the closed chamber portion of the shoe, this sliding block being selectively positioned so as to substantially shut off air flow from at least one-quarter of the area of the shoe.

21. An aerating and vibrating apparatus as in claim 20 in which the sliding block is carried on rails, rods and the like so as to maintain and move in a determined plane parallel with the undersurface of the shoe and with the block selectively cycled so as to be moved in way of all the openings during a cycle of the shoe.

22. An aerating and vibrating apparatus as in claim 20 in which the sliding block is approximately one-half the width of the undersurface of the shoe and the block is cycled in response to the position of the shoe in its reciprocation under the stack of sheets.

23. An aerating and vibrating apparatus as in claim 20 in which the movement of the sliding block uncovers the holes formed in the leading edges of the shoes.

24. An aerating and vibrating apparatus as in claim 20 in which the movement of the sliding block uncovers the holes formed in the trailing edges of the shoe.

25. A method of aerating and vibrating a stack of sheet material such as cardboard, paper and the like in which the stack is transportable on a skid to said apparatus, said method steps including: (a) providing a lift frame including a pair of platform members and moving these platform members toward one another so as to engage a stack of sheets on its flat top and bottom surfaces and grasping said stack and when so grasped the stack is turned substantially to bring the stack to a vertical edgewise condition and after turning, moving the platforms apart sufficiently to permit aerating and vibrating of the loosened stack of sheets; (b) providing a side support frame carried by the lift frame and moving the frame to a position whereat one edge of the stack is supported and is aligned; (c) providing and cycling a vibrator support frame and carrying this support frame on the side frame and moving the frame back and forth at a selected and determined speed; (d) positioning at least one vibrated shoe carried on a support structure and moving this shoe and structure in a common plane and line which is substantially coincident with a plane normal to the bottom supported edge of the sheet as provided by the side support frame; (e) vibrating the movable shoe in a controlled direction and amplitude and toward and away from the side frame and forming the vibrated shoe with a flat support surface at that portion which is brought into engagement with the supported edges of the stack of sheets when the stack is lifted and turned and agitating the sheets as the air is blown therebetween without a lifting of the sheets from the vibrated shoe above the support surface provided by the side support frame; (f) mounting a spring at such an angle that these springs are disposed to carry the shoe during the vibrating of this shoe and during vibration to carry and move locally the sheets in association with the shoe to a stop surface provided on the side frame; (g) mounting on the shoe a vibrator having a cycle and amplitude adjusting means and carrying said vibrator on said shoe so that the imposed vibrations are in a plane substantially parallel to the plane of the sheets in the stack; (h) providing and carrying an air conduit so as to be movable with the vibrator frame, this air conduit supplied with a large volume of low pressure air and disposed to feed this air to the vibrated shoe; (i) forming air passageways at and in the carrying surface of the shoe and connecting these air passageways to the conduit so that a large volume of low pressure air from the conduit is supplied to these passageways, and (j) forming a plurality of air outlets in the carrying surfaces of each shoe, each of the outlets so formed and positioned as to direct a stream of pressurized air upwardly and locally to and through the stack of sheet material as and after the platform members holding this material are loosened to allow vibrating and aerating of the sheets.

* * * * *